US007780847B2

(12) United States Patent
Choi

(10) Patent No.: US 7,780,847 B2
(45) Date of Patent: Aug. 24, 2010

(54) METHOD OF PRODUCING LOW SULFUR, HIGH OCTANE GASOLINE

(75) Inventor: Ki-Hyouk Choi, Dhahran (SA)

(73) Assignee: Saudi Arabian Oil Company (SA)

( * ) Notice: Subject to any disclaimer, the term of this patent is extended or adjusted under 35 U.S.C. 154(b) by 81 days.

(21) Appl. No.: 11/906,253

(22) Filed: Oct. 1, 2007

(65) Prior Publication Data

US 2009/0084709 A1 Apr. 2, 2009

(51) Int. Cl.
*C10G 29/00* (2006.01)

(52) U.S. Cl. ..... 208/302; 208/208 R; 208/209; 208/211; 208/216 R; 208/217; 208/299; 208/303; 502/400; 502/407; 502/415; 502/416; 502/417

(58) Field of Classification Search ..... 208/133–134, 208/141, 208 R, 209, 211, 216–217, 250, 208/299, 302–303, 305–307; 502/400, 407, 502/415–417

See application file for complete search history.

(56) References Cited

U.S. PATENT DOCUMENTS

| | | | | |
|---|---|---|---|---|
| 5,597,476 | A * | 1/1997 | Hearn et al. | 208/208 R |
| 6,120,679 | A | 9/2000 | Hatanaka et al. | |
| 6,303,020 | B1 | 10/2001 | Podrebarac et al. | |
| 6,334,948 | B1 | 1/2002 | Didillon et al. | |
| 6,610,197 | B2 | 8/2003 | Stuntz et al. | |
| 6,623,627 | B1 | 9/2003 | Zhou | |
| 2003/0217952 | A1* | 11/2003 | Brignac et al. | 208/217 |
| 2004/0007506 | A1 | 1/2004 | Song et al. | |
| 2004/0118748 | A1 | 6/2004 | Lesemann et al. | |
| 2004/0178123 | A1* | 9/2004 | Podrebarac | 208/211 |
| 2004/0188327 | A1* | 9/2004 | Groten | 208/210 |
| 2005/0075528 | A1* | 4/2005 | Burkhardt et al. | 585/820 |

FOREIGN PATENT DOCUMENTS

| | | | |
|---|---|---|---|
| FR | 2913235 | A1 | 9/2008 |
| WO | 9967345 | A2 | 12/1999 |

OTHER PUBLICATIONS

Hernandez et al. "Desulfurization of Transportation Fuels by Adsorption", Catalysis Reviews (2004), vol. 46, No. 2, pp. 111-150.

Choi et al. "Impact of removal extent of nitrogen species in gas oil on its HDS performance: an efficient approach to its ultra deep desulfurization", Applied Catalysis B: Environmental (2004), vol. 50, pp. 9-16.

Sano et al. "Adsorptive removal of sulfur and nitrogen species from a straight run gas oil over activated carbons for its deep hydrodesulfurization", Applied Catalyis B: Environmental (2004), vol. 49, pp. 219-225.

Min "A Unique Way to Make Ultra Low Sulfur Diesel", Korean Journal of Chemical Engineering, vol. 19, No. 4 (2002), pp. 601-606, XP008084152.

* cited by examiner

*Primary Examiner*—Robert J Hill, Jr.
*Assistant Examiner*—Brian McCaig
(74) *Attorney, Agent, or Firm*—Bracewell & Giuliani LLP

(57) ABSTRACT

A process for producing gasoline having reduced sulfur content while maintaining or improving octane rating is provided. A gasoline fraction having a substantial amount of olefinic and sulfur compounds produced from fluidized catalytic cracking or coking is contacted first with an adsorbent to selectively remove alkylated thiophenic, benzothiophene, and alkylated benzothiophenic sulfur compounds. The adsorptively treated gasoline fraction is then introduced into a conventional hydrodesulphurizing catalyst bed with hydrogen for further removal of sulfur compounds. Adsorbent containing alkylated thiophenic, benzothiophene, and alkylated benzothiophenic compounds are regenerated through washing with a hydrocarbon solvent and subsequent drying-out by warming.

41 Claims, 3 Drawing Sheets

Intensity v. Retention Time

METHOD OF PRODUCING LOW SULFUR, HIGH OCTANE GASOLINE

TECHNICAL FIELD OF THE INVENTION

The present invention relates generally to the production of gasoline, and in particular to a process for producing gasoline having low sulfur content and a high octane rating.

BACKGROUND OF THE INVENTION

In the petroleum industry, it is common for gasoline fuels to become contaminated with sulfur. Engines and vehicles utilizing sulfur-contaminated fuels can produce harmful emissions of nitrogen oxide, sulfur oxide and particulate matter. Government regulations have become more stringent in recent years with regard to allowable levels of these potentially harmful emissions, which has led refiners to seek ways to reduce sulfur levels in these fuels.

Gasoline fuel is generally prepared by blending several petroleum fractions. Typical refineries blend, among other blendstocks, catalytically cracked gasoline (CCG), coker gasoline, straight run naphtha, reformats, isomerate and alkylate to produce gasoline fuel having pre-designed specifications. Among such various blendstocks, CCG (which is produced from fluidized catalytic cracking) is responsible for a substantial portion of the sulfur content in the resulting blended gasoline pool. Therefore, removal of sulfur compounds contained in CCG is an important step in meeting the rigorous regulations on sulfur content in gasoline fuel.

Various methods have been proposed to reduce sulfur levels in these CCG-containing fuels. However, there are disadvantages associated with these previously proposed methods. In general, removal of sulfur compounds from CCG-containing petroleum fractions is accomplished by catalytic hydrodesulphurization, whereby the petroleum fractions are contacted with solid catalyst in the presence of hydrogen gas. Hydrogen disulfide is a product of certain of these reactions. Typical hydrodesulphurization catalyst consists of alumina support, molybdenum sulfide, cobalt sulfide and/or nickel sulfide. The cobalt sulfide and/or nickel sulfide are added to the catalyst in order to increase catalytic activity and selectivity.

There are disadvantages or limitations to using hydrodesulphurization alone for sulfur removal. For example, sulfur compounds contained in petroleum streams have a wide variety of reactivity in catalytic hydrodesulphurization. Bruce C. Gates (Ind. Eng. Chem. Res. Vol. 30, pp. 2021-2058, 1991) indicated that pseudo first order reaction rates of hydrodesulphurization for thiophene, benzothiophene, and dibenzothiophene are known to be 100, 59, and 4, respectively, although extent of such differences depends on the chemical composition, for example, olefin content, in feedstock. Additionally, alkyl group substituents on thiophenic and benzothiophenic molecules diminish the reactivity of those molecules in hydrodesulphurization. Therefore, much higher temperatures and hydrogen pressures are required to hydrodesulphurize CCG-containing petroleum feedstocks containing alkylated thiophenic, benzothiophene, and alkylated benzothiophenic compounds than feedstock containing thiophenic compounds only.

Along with high temperature and high pressure hydrodesulphurization, hydrogenation of other compounds in the CCG feedstock, including the carbon-carbon bonds of olefinic compounds, also occurs. Olefinic compounds contained in CCG contribute significantly to the high octane rating of the feedstock. Hydrogenation of these olefinic compounds to paraffinic compounds results in a lowering of octane rating which is undesirable for automobile applications of gasoline. Significant loss of octane rating during catalytic hydrodesulphurization of CCG must be compensated through blending substantial amounts of reformate, isomerate and alkylate into the gasoline pool, which is detrimental to the economy of the refining process.

Olefinic compounds are concentrated in low boiling point range fractions of CCG, while sulfur compounds are concentrated in high boiling point range fractions of CCG. Therefore, certain prior art patents show separate processing of low boiling point and high boiling point fractions of CCG.

For example, U.S. Pat. No. 6,623,627 involves fractionating feed gasoline into three streams, each of which is subsequently treated by a different method to attain low sulfur gasoline without severe hydrogenation of olefinic compounds. U.S. Pat. No. 6,303,020 involves catalytic distillation and inter-stage $H_2S$ removal to maintain high octane rating and low sulfur content in the product gasoline. U.S. Pat. No. 6,334,948 involves separating feed gasoline into light and heavy fractions and then treating each fraction with different catalysts. U.S. Pat. No. 6,610,197 involves separating catalytically cracked naphtha into light and heavy fractions and then treating the fractions to obtain low sulfur gasoline product. In particular, U.S. Pat. Nos. 6,334,948 and 6,610,197 utilize fractionation as an initial step followed by catalytic hydrogenative desulfurization.

None of these methods, however, achieve the desired sulfur reduction and substantially similar octane levels economically, i.e., at low temperature and low hydrogen pressure levels and milder reaction conditions, or prevent a significant amount of hydrogenation of olefinic compounds when used alone. Furthermore, CCG having a high end boiling point is very difficult to desulphurize due to its high sulfur content. Therefore, undercutting of CCG to have low sulfur content has been recognized as a means for deep desulphurization, although it decreases the production amount of valuable gasoline.

Catalysts which have high selectivity toward hydrodesulphurization rather than hydrogenation of olefinic compounds have been also proposed. An example of such a prior art catalyst is molybdenum sulfide supported on neutral alumina. However, these catalysts are designed to have higher selectivity toward hydrodesulphurization of sulfur compounds rather than hydrogenation of olefinic compounds and thus, sacrifice hydrodesulphurization activity to suppress hydrogenation activity, which is not suitable for practical application.

Non-catalytic methods to remove sulfur compounds from gasoline feedstock have also been proposed to prevent the loss of octane rating that typically accompanies catalytic hydrodesulphurization. Examples of representative non-catalytic desulphurization methods typically include using adsorbents such as zeolite to selectively remove certain specific sulfur compounds contained in gasoline feedstock. However, zeolitic adsorbent is very difficult to regenerate. Also, certain of these prior art methods are directed only towards treating those portions of gasoline having concentrated sulfur compounds, or only towards certain types of fuels such as diesel fuels. Additionally, the industry recognizes that there is very difficult to remove large amounts of sulfur compounds contained in feed CCG to be less than a few tens of weight ppm level.

Further, non-catalytic removal of sulfur compounds requires large amounts of reagent and its storage and recycle devices, which can be economically unfeasible, and is often capable of removing only certain specific types of sulfur compounds when used alone, which makes its application limited for use in a broad range of industrial processes. Further, certain adsorption technologies, in particular gas phase adsorption, consume prohibitively high amounts of energy.

It would be beneficial to have a process for obtaining gasoline having reduced sulfur content by mild hydrodesulphurization without the need for post treatment even when using CCG having a high end boiling point and/or high sulfur content. It would also be beneficial to have a process for simple adsorptive treatment of CCG feedstock to achieve deep hydrodesulphurization of CCG without severe hydrogenation of olefinic compounds, in order to maintain a high octane rating of CCG feedstock. It would also be beneficial to have a process which allows partial removal of specific sulfur compounds from a CCG gasoline feedstock having a full boiling point range via adsorption such that the adsorbent can have a long run length until saturation.

SUMMARY OF THE INVENTION

The present invention advantageously provides a process for producing gasoline having reduced sulfur content while maintaining or improving octane rating. In an embodiment, a gasoline stream having a substantial amount of olefinic and sulfur compounds produced from fluidized catalytic cracking or coking is contacted first with an adsorbent in an adsorption stage to selectively remove alkylated thiophenic, benzothiophene, and alkylated benzothiophenic sulfur compounds, thereby creating an adsorptively treated gasoline effluent stream. The adsorption is preferably liquid phase adsorption. The adsorptively treated gasoline effluent stream, or absorptively treated gasoline fraction, is then introduced into a conventional hydrodesulphurizing catalyst bed with hydrogen for further removal of any remaining sulfur compounds from the adsorptively treated stream using a solid catalyst in a hydrodesulphurization stage. The separated sulfur compounds are then stripped and removed in the form of hydrogen disulfide from the adsorptively treated stream to produce a product gasoline stream. Adsorbent containing thiophene, alkylated thiophenic, benzothiophene, and alkylated benzothiophenic compounds is regenerated by washing with a hydrocarbon solvent and subsequent drying-out by warming or applying vacuum.

In an embodiment, the invention includes a process for reducing the sulfur content of a catalytically cracked gasoline stream. The catalytically cracked gasoline stream can contain thiophene, alkylated thiophenic, benzothiophene, alkylated benzothiophenic and other sulfur compounds. The catalytically cracked gasoline stream is contacted with an adsorbent to produce an adsorptively treated effluent stream. The adsorptively treated effluent stream is then hydrodesulphurized with a solid catalyst in the presence of hydrogen to separate substantially all of the other remaining sulfur-containing compounds from the adsorptively treated effluent stream. Preferably, the alkylated thiophenic, benzothiophene, and alkylated benzothiophenic compounds are removed from the stream, leaving the other sulfur compounds remaining in the stream. The catalytically cracked gasoline stream preferably has an initial assay describing the boiling point range, including a light fraction and a heavy fraction.

The sulfur-containing species are then stripped and removed in the form of hydrogen disulfide from the hydrodesulphurized stream to produce a product gasoline stream, whereby the product gasoline stream has reduced sulfur content and a substantially similar octane rating as the catalytically cracked gasoline stream. The gasoline stream can also be a coker gasoline stream in an embodiment of the invention.

In an embodiment of the present invention, the full boiling range CCG can be fractionated to light and heavy fractions after adsorption but before catalytic hydrogenative desulfurization because olefinic and sulfur compounds are concentrated in light and heavy fractions, respectively. The heavy fraction, which contains large amount of sulfur compounds, can be desulfurized without serious concern about hydrogenation of olefinic compounds because it contains fewer olefinic compounds than the light fraction. The splitting point is generally dependent on feedstock properties, reaction conditions, catalyst, and target properties of the product stream. The adsorptive pre-treatment step allows catalytic desulfurization to be performed at milder conditions than suggested by the prior art because a significant amount of refractory sulfur compounds have been removed. In an embodiment of the invention, the splitting point can be adjusted between 30° C.-120° C., preferably, 40° C.-100° C.

The process can further include the steps of splitting the adsorptively treated effluent stream into light and heavy fractions, hydrodesulphurizing the heavy fraction with a solid catalyst to remove substantially all of the other remaining sulfur-containing species from the adsorptively treated gasoline effluent stream and stripping most or substantially all of the other sulfur-containing species from the heavy fraction hydrodesulphurized product stream in the form of hydrogen disulfide to produce a product gasoline stream that has reduced sulfur content and a substantially similar octane rating as the CCG stream. The heavy fraction is preferably combined with the light fraction after stripping. The light fraction is easily desulphurized separately by a suitable method such as caustic extraction.

To further clarify the substantial similarity in octane rating of the CCG stream and the product gasoline stream, the expected difference in octane loss, as estimated by the difference in Research Octane Number (RON) measured by GC-PIONA, is less than about 2. This RON loss can be achieved after combining light and heavy fractions in an embodiment of the invention. The gasoline stream can also be a coker gasoline stream in an embodiment of the invention.

Preferably, the initial gasoline stream is produced by fluidized catalytic cracking of light cycle oil, heavy cycle oil, vacuum gas oil, atmospheric resid, and vacuum resid, or their mixtures. Alternately, the gasoline stream is produced by coking of light cycle oil, heavy cycle oil, vacuum gas oil, atmospheric resid and vacuum resid, or their mixtures. The gasoline preferably exhibits a full boiling point range from 0° C. to 300° C., preferably, between 50° C. and 280° C. The full boiling point range gasoline preferably has a total sulfur content between 10 wt ppm sulfur and 20,000 wt ppm sulfur, and contains concentrated sulfur compounds as well. Full boiling point range CCG can contain sulfides, mercaptans, thiols, thiophene, alkylated thiophenes, benzothiophene, alkylated benzothiophenes, dibenzothiophene, and alkylated dibenzothiophenes. The full boiling point range gasoline can also have a total content of olefinic compounds between 5 wt % and 70 wt %.

Preferably, the adsorbent is selected from the group consisting of silica, alumina, silica-alumina, zeolite, synthetic clay, natural clay, activated carbon, activated charcoal, activated carbon fiber, carbon fabric, carbon honeycomb, alumina-carbon composite, silica-carbon composite, and carbon black. The adsorbent can also contain metallic components selected from Groups VI and VIII of the periodic table. The adsorbent can be pre-treated by thermal treatment, chemical treatment and physical treatment before being exposed to flowing gasoline feedstock.

Adsorption is preferably performed at 0° C. to 90° C., preferably, at 10° C. to 50° C. The temperature of the hydrodesulphurizing stage can be between 100° C. to 350° C., preferably, between 150° C. and 300° C. The hydrogen pressure can be between 0.5 MPa to 7 MPa, preferably, between 1 MPa to 4 MPa.

The hydrotreating catalyst preferably consists of at least one compound selected from the group consisting of alumina, silica, silica-alumina, zeolite, synthetic clay, natural clay, activated carbon, activated carbon fiber and carbon black, and at least two compounds selected from Group VIII and Group VI of the periodic table. The catalyst can also include at least one compound selected from the group consisting of boron, nitrogen, fluorine, chlorine, phosphorous, potassium, magnesium, sodium, rubidium, calcium, lithium, strontium and barium. The stripping gas is preferably selected from the group consisting of nitrogen, hydrogen, argon, helium or their mixtures. The hydrocarbon solvent can be selected from the group consisting of toluene, benzene, xylene, straight run naphtha, ethanol, isopropanol, n-butanol, i-butanol, n-pentanol, i-pentanol, ketones, and ethers, and their mixtures.

The drying temperature is preferably between 10° C. and 150° C., more preferably, between 30° C. and 70° C. The adsorbent can be subjected to a vacuum pressure between 0.1 mmHg and 300 mmHg during regeneration. The adsorbent can also be subjected to flowing gas selected from the group consisting of air, nitrogen, helium and argon during regeneration.

The effluent from the adsorption stage can be split into light and heavy fractions by distillation in an embodiment of the invention. The splitting temperature is preferably between 30° C. and 120° C., more preferably, 40° C. to 100° C. In an embodiment of the present invention, the process for obtaining gasoline having reduced sulfur content by mild hydrodesulphurization is enabled by pre-removal of alkylated thiophenic, benzothiophene and alkylated benzothiophenic sulfur compounds of full boiling point range CCG by adsorption treatment prior to fractionation into a light/heavy split in an embodiment of the present invention. Simple adsorptive treatment of CCG feedstock at room temperature makes it possible to achieve deep hydrodesulphurization of CCG without severe hydrogenation of olefinic compounds, which results in a high octane rating of processed CCG feedstock. Partial removal of specific sulfur compounds enables the adsorbent to have a longer run length until saturation. Furthermore, regeneration of adsorbent is simply performed by washing with a hydrocarbon solvent and drying-out at elevated temperature.

The light fraction can be treated by caustic extractor to remove light sulfur compounds. The heavy fraction can be treated by a hydrodesulphurization reaction. The temperature of the hydrodesulphurizing stage is between 100° C. to 350° C., preferably, between 150° C. and 300° C. The hydrogen pressure is between 0.5 MPa to 7 MPa, preferably, between 1 MPa to 4 MPa. The hydrotreating catalyst can comprise at least one compound selected from the group consisting of alumina, silica, silica-alumina, zeolite, synthetic clay, natural clay, activated carbon, activated carbon fiber, and carbon black, at least two compounds selected from Group VIII and Group VI of the periodic table and at least one compound selected from the group consisting of boron, nitrogen, fluorine, chlorine, phosphorous, potassium, magnesium, sodium, rubidium, calcium, lithium, strontium, and barium. The hydrodesulphurization product stream can be stripped with at least one gas selected from the group consisting of nitrogen, hydrogen, argon, and helium to remove sulfur-containing components.

In a preferred embodiment of the present invention, thiophenic compounds having substitutes of three or higher carbon atoms, benzothiophene and benzothiophenic compounds having substitutes of one or higher carbon atoms are selectively removed.

Preferably, an appropriate adsorbent selectively removes alkylated thiophenic, benzothiophene, and alkylated benzothiophenic sulfur compounds, which have very low reactivity in hydrodesulphurization, from full boiling point range CCG feedstock at room temperature. Adsorptively treated full range CCG shows very high reactivity in hydrodesulphurization at mild conditions because of the absence of refractory sulfur compounds. Hydrogenation of olefinic compounds is avoided by mild hydrodesulphurizing conditions.

The process of the present invention allows for treatment of full boiling point range CCG to attain very low sulfur content by a single hydrodesulphurization stage with highly active hydrodesulphurization catalyst. Mild hydrodesulphurizing as disclosed in the present invention prevents severe hydrogenation of olefinic compounds present in CCG during hydrodesulphurization, which results in little loss of octane number even after catalytic hydrodesulphurization.

The present invention allows for significant removal of sulfur compounds contained in CCG without over-hydrogenating olefinic compounds because pre-treatment can remove refractory sulfur species, which makes it possible to adopt milder reaction condition to achieve ultra low sulfur content without substantially lowering octane rating.

The pre-removal of alkylated thiophenic, benzothiophene, and alkylated benzothiophenic sulfur compounds from CCG greatly enhances the hydrodesulphurization reactivity of CCG. The selective removal of alkylated thiophenic, benzothiophene, and alkylated benzothiophenic sulfur compounds can be achieved by using an appropriate adsorbent. The adsorption stage is preferably performed at low temperature without any gas feeding. Improved reactivity of CCG makes it possible to achieve very low sulfur content of CCG by mild hydrodesulphurization, which prevents the severe hydrogenation of olefinic compounds contained in CCG feedstock. The content of olefinic compounds contained in the resulting low sulfur content CCG is substantially the same with that of CCG feedstock in an embodiment of the present invention. The adsorbent can be simply regenerated by common solvent.

BRIEF DESCRIPTION OF THE DRAWINGS

So that the manner in which the features, advantages and objects of the present invention, as well as others that will become apparent, may be understood in more detail, more particular description of the invention briefly summarized above may be had by reference to the embodiments thereof that are illustrated in the appended drawings, which form a part of this specification. It is to be noted, however, that the drawings illustrate only a preferred embodiment of the invention and are therefore not to be considered limiting of the invention's scope as it may admit to other equally effective embodiments.

DETAILED DESCRIPTION

Figure 1:
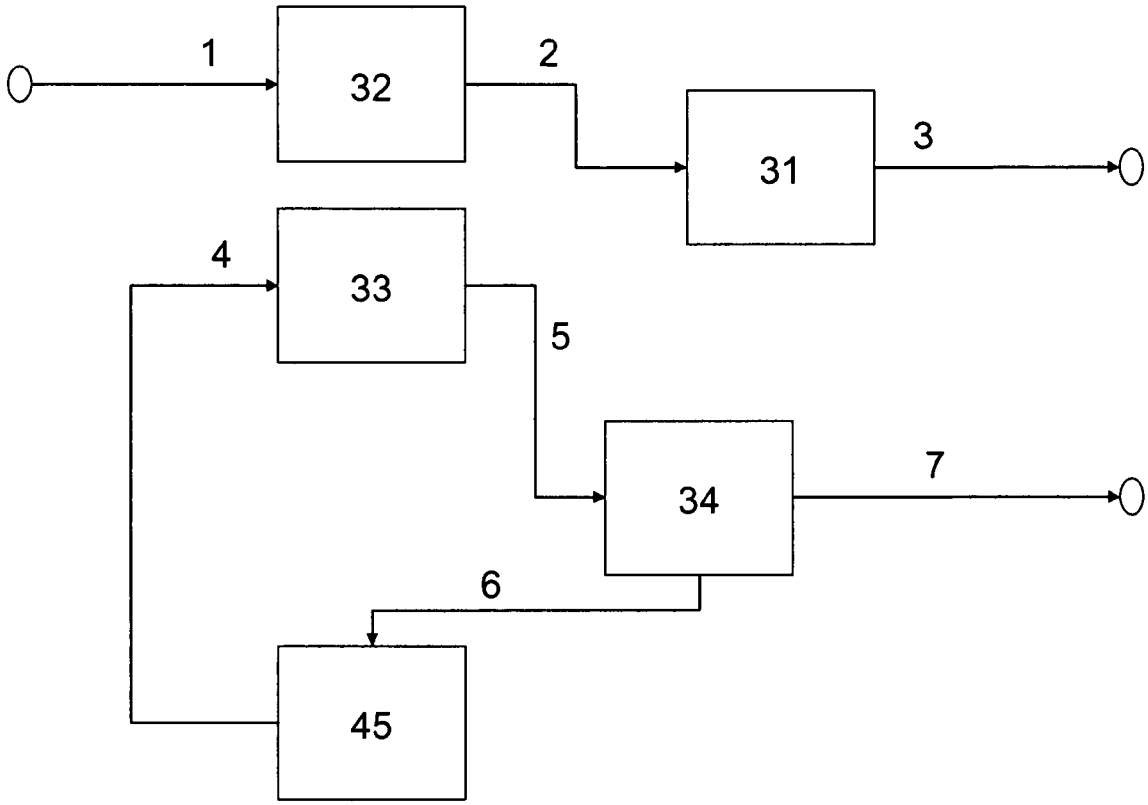
FIG. 1 is a simplified side view of a process according to an embodiment of the present invention.

A process for producing low sulfur gasoline is disclosed herein which comprises an initial adsorption stage and a subsequent catalytic hydrodesulphurization stage. A regeneration procedure for adsorbent is also disclosed herein. Preferably, the process feed stream is a gasoline fraction having a boiling point range of 0° C. to 280° C., produced from fluidized catalytic cracking or coking. The adsorbent is selected from the group consisting of silica, alumina, silica-alumina, zeolite, synthetic clay, natural clay, activated carbon, activated charcoal, activated carbon fiber, carbon fabric, carbon honeycomb, alumina-carbon composite, silica-carbon composite, and carbon black. Adsorbent may also contain metallic components selected from Groups VI and VIII of the periodic table. Adsorbent may be pre-treated by thermal treatment, chemical treatment and physical treatment before the gasoline feedstock is introduced to the adsorbent to improve adsorption capacity.

In an embodiment of the invention, fresh and regenerated adsorbent preferably selectively removes alkylated thiophenic, benzothiophene, and alkylated benzothiophenic sulfur compounds from a CCG stream to produce a partially desulphurized CCG stream. Preferably, fresh adsorbent removes selectively benzothiophenic sulfur compounds having higher boiling points than benzothiophene. Adsorption takes place at 0° C. to 90° C., preferably, 10° C. to 50° C. The adsorptively treated fluid catalytically cracked (FCC) gasoline is then introduced to a hydrodesulphurizing stage to remove remaining sulfur compounds by reaction over catalyst in the presence of hydrogen. The adsorptively treated gasoline is hydrodesulfurized to a very low sulfur level without severe hydrogenation of olefinic compounds contained in the feedstock, which mainly provide high octane rating to gasoline fuels. Partial removal of alkylated thiophenic, benzothiophene, and alkylated benzothiophenic sulfur compounds, which are known to have lower reactivity than low boiling point thiophenic compounds, from CCG by adsorption greatly improves the reactivity of gasoline in hydrodesulphurization. Such improved reactivity of CCG makes it possible to attain the same sulfur content by much lower temperature and hydrogen pressure when compared with non-treated CCG.

In other words, much higher temperature and higher hydrogen pressure are required to hydrodesulphurize CCG that contain alkylated thiophenic, benzothiophene, and alkylated benzothiophenic sulfur compounds than CCG containing only thiophenic compounds having substitutes of two or less carbon atoms. Such severe reaction conditions inevitably cause oversaturation of olefinic compounds through hydrogenation of unsaturated carbon-carbon bonds. As a result of olefin saturation, octane number is greatly decreased. Low octane number of hydrodesulfurized CCG requires a significant amount of expensive reformate, isomerate, and alkylate as blendstocks to meet the specifications for a desired octane rating. In contrast, mild hydrodesulphurizing conditions disclosed in the present invention prevent severe hydrogenation of olefinic compounds present in CCG during hydrodesulphurization, which results in little loss of octane number even after catalytic hydrodesulphurization. Used adsorbent can be restored to its full adsorption capacity by washing with common hydrocarbon solvent selected from toluene, benzene, xylene, straight run naphtha, ketones and their mixtures, followed by drying at lower than 100° C., in an embodiment of the invention.

An embodiment of the present invention is illustrated in FIG. 1. CCG feed is introduced via line 1 into adsorption bed 32. Adsorptively treated CCG containing a reduced amount of alkylated thiophenic, benzothiophene, and alkylated benzothiophenic sulfur compounds flows out of the adsorption bed 32 via line 2 and is then fed into hydrodesulphurizing reactor 31. Stripping gas in reactor 31 strips substantially all the remaining sulfur containing species from the adsorptively treated stream in the form of hydrogen sulfide. In a hydrodesulphurizing reactor, a substantial amount of sulfur compounds are decomposed through reaction with hydrogen over a catalyst. Sulfur atoms are extracted from sulfur compounds and converted to hydrogen sulfide with aid of a catalyst. Hydrogen sulfide and light hydrocarbon are removed at the stripping stage. In particular, hydrogen sulfide should preferably be removed just after hydrodesulphurization because it can be recombined with olefinic compounds to form thiophenic compounds, which results in an increase in the sulfur content of the product. The stripping gas is selected from one or more of the group consisting of nitrogen, hydrogen, argon, and helium. Hydrodesulfurized CCG having very low sulfur content is removed from hydrodesulphurizing reactor 31 via line 3 to be introduced to the gasoline pool.

At the same time, saturated adsorption bed 33 is regenerated by a hydrocarbon solvent, which is fed via line 4. Solvent carrying concentrated alkylated thiophenic, benzothiophene, and alkylated benzothiophenic sulfur compounds flows out of adsorption bed 33 via line 5 and is then fed into solvent recovery unit 34 to separate sulfur compounds from solvent. The sulfur-rich stream is introduced into another hydrodesulphurization reactor, for example a diesel or vacuum gas oil hydrodesulphurization reactor, via line 7. Separated solvent is fed into solvent storage tank 45 via line 6.

Figure 2:
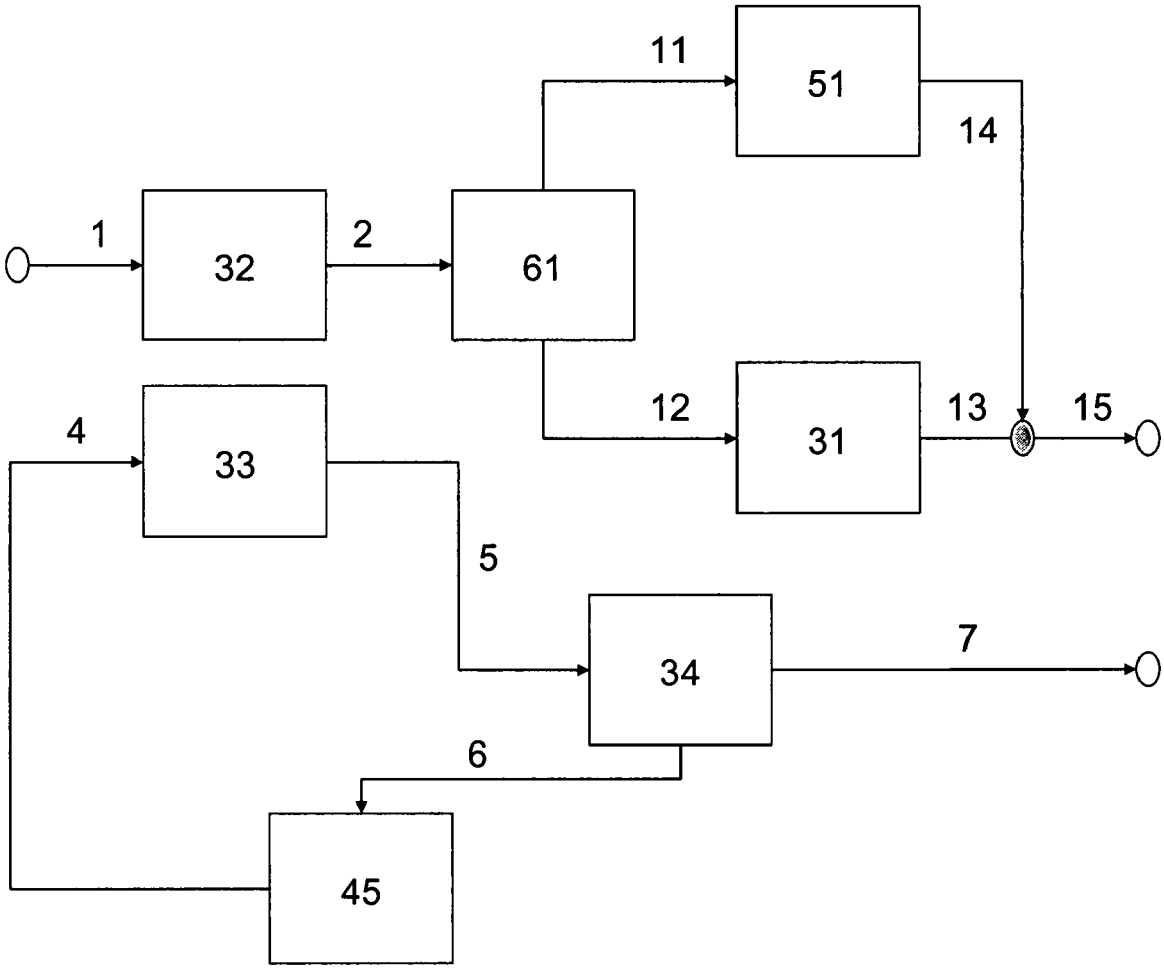
FIG. 2 is a simplified side view of a process according to an embodiment of the present invention.

Another embodiment of the present invention is illustrated in FIG. 2. CCG feed is introduced via line 1 into adsorption bed 32. Adsorptively treated CCG containing a reduced amount of alkylated thiophenic, benzothiophene, and alkylated benzothiophenic sulfur compounds flows out of adsorption bed 32 via line 2 and then is fed into fractionator 61. The fractionator 61 separates the treated CCG into a light fraction and a heavy fraction. Splitting point can be selected between 30° C.-120° C., preferably, 40° C.-100° C. Volumetric yields to light and heavy fractions are about 20-60 vol % and 80-40 vol %, respectively. The light fraction is introduced into desulfurizing stage 51, for example, a caustic extractor to remove mercaptans, via line 11, and the heavy fraction is fed into hydrodesulphurizing reactor 31 via line 12. A hydrodesulfurized heavy fraction of CCG having reduced sulfur content is removed via line 13 and combined with the desulphurized light fraction of CCG via line 14 to be introduced to a gasoline pool via line 15.

Saturated adsorption bed 33 is regenerated by a hydrocarbon solvent, which is fed via line 4. Solvent carrying concentrated alkylated thiophenic, benzothiophene, and alkylated benzothiophenic sulfur compounds flow out of adsorption bed 33 via line 5. Line 5 is then fed into solvent recovery unit 34 to separate sulfur compounds from solvent. The sulfur-rich stream is introduced into another hydrodesulphurization reactor, for example diesel or vacuum gas oil hydrodesulphurization reactor, via line 7. Separated solvent is fed into solvent storage tank 45 via line 6.

The process of the present invention is further demonstrated by the following example and illustrative embodiment, which is not meant to limit the process of the present invention. Illustrative embodiment data has not been actually acquired, but is considered illustrative of the expected performance of the present invention.

Example 1

Figure 3:
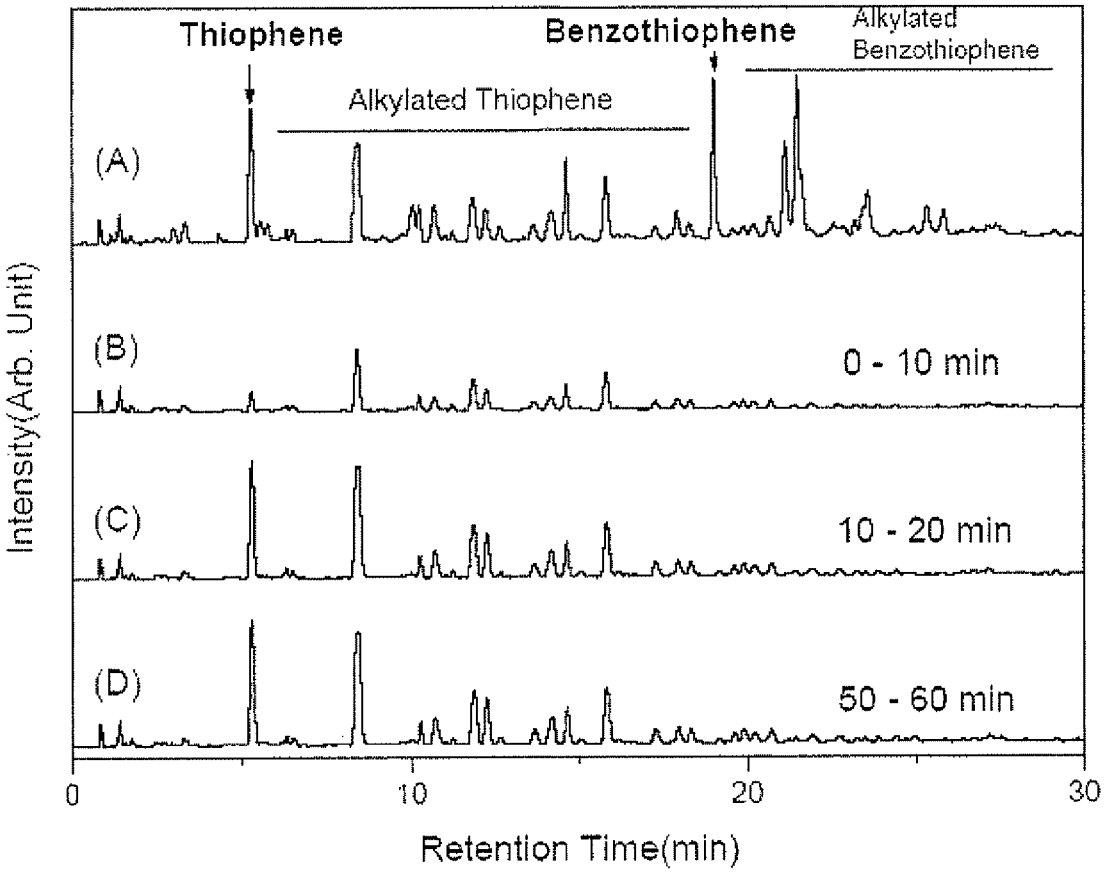
FIG. 3 is a graph illustrating sulfur specific chromatographs of effluent streams for a CCG feedstock according to an embodiment of the present invention.

1.2752 grams of silica-alumina powder (Aldrich, Grade 135) is dried at 110° C. for 6 hours prior to adsorption testing. Dried silica-alumina powder is packed into a stainless steel tube of 50 mm length and 8 mm diameter. Full range catalytically cracked naphtha having 2300 wt ppm sulfur is fed into the tube by an HPLC pump at the rate of 0.2 ml/min. The adsorption temperature is room temperature. Sulfur-specific chromatograms of the effluents, which were sampled for 10 minutes, are shown in FIG. 3. As clearly indicated in the figure, silica-alumina adsorbent very selectively removes alkylated thiophenic, benzothiophenic and alkylated benzothiophenic sulfur compounds from the CCG feedstock. After passing CCG for 100 minutes, the recovered amount of CCG is above 99.5 vol %.

Illustrative Embodiment 3,000 barrels per day (BPD) of a full boiling point range catalytically cracked gasoline produced from fluidized catalytic cracking of vacuum gas oil having 2,300 wt ppm sulfur, 25 wt % olefin, initial and final boiling points at 29° C. and 228° C., respectively, is contacted with silica-alumina adsorbent which is packed in a 4.7 $m^3$ tubular reactor, at 30° C. with liquid hourly space velocity of 4.7 $hr^{-1}$. After treating CCG for 12 hours, the feed stream is changed to the regenerated adsorbent reactor for continuous operation. Effluent from silica-alumina adsorbent reactor has 1,982 wt ppm sulfur and 25 wt % olefin. 95 wt % of benzothiophenic sulfur compounds having higher boiling points than benzothiophene are removed by the adsorption stage. Effluent from the adsorption stage is introduced into a hydrodesulphurizing reactor, in which $CoMo/Al_2O_3$ catalyst is packed. Hydrodesulphurization is performed at 250° C., total pressure of 2 MPa, space velocity of 5 $hr^{-1}$, and hydrogen to oil ratio of 60 $m^3/m^3$. The resulting product has 23 wt ppm sulfur (99% desulphurization) and 20 wt % olefin (5 wt % olefin loss).

In contrast, hydrodesulphurization of the same CCG without adsorptive pre-treatment to attain the same sulfur content of the product results in loss of olefinic compounds as much as 10 wt % olefin, which greatly decreases octane rating.

The present invention makes it possible to attain lower sulfur levels at lower operating temperatures and pressures. Olefins generally have a high octane rating. However, large amount of olefins are hydrogenated to paraffins during hydrodesulphurization. Olefin loss causes a decrease in octane rating. Low operating temperature and low operating hydrogen pressure suppress hydrogenation of olefins such that desulphurization conversion is too low to meet strict regulations on sulfur content of gasoline. In general, the higher the hydrodesulphurization conversion, the higher the octane rating loss. High temperatures of hydrodesulphurization cause large losses of octane rating due to severe hydrogenation of olefins.

Therefore, the present invention, which can substantially desulfurize the gasoline fraction without severe hydrogenation of olefins, is desirable. Selective catalysts are not a preferred solution for low sulfur gasoline because its hydrodesulphurization activity is very limited. 3 or 5 octane (RON) loss is inevitable for ultra deep hydrodesulphurization of cracked gasoline having high sulfur content. Such mild conditions prevent olefins from being hydrogenated severely.

Pre-removal of alkylated thiophenic, benzothiophene, and alkylated benzothiophenic sulfur compounds from CCG greatly enhances hydrodesulphurization reactivity of CCG. Selective removal of alkylated thiophenic, benzothiophene, and alkylated benzothiophenic sulfur compounds can be achieved by using an appropriate adsorbent. The adsorption stage is performed at low temperature without any gas feeding. Improved reactivity of CCG makes it possible to achieve very low sulfur content of CCG by mild hydrodesulphurization, which prevents severe hydrogenation of olefinic compounds contained in CCG feedstock. Content of olefinic compounds contained in the resulting low sulfur content CCG is substantially the same as that of CCG feedstock. Adsorbent is simply regenerated by common solvent.

While the invention has been shown or described in only some of its forms, it should be apparent to those skilled in the art that it is not so limited, but is susceptible to various changes without departing from the scope of the invention.

What is claimed is:

1. A process for reducing the sulfur content of a catalytically cracked gasoline stream containing alkylated thiophenic, benzothiophene, alkylated benzothiophenic and other sulfur compounds comprising the steps of:

providing a catalytically cracked gasoline stream having a boiling point range of about 0° C. to 300° C.;

contacting all the catalytically cracked gasoline stream with an adsorbent to adsorptively remove substantially all the alkylated thiophenic, benzothiophene and alkylated benzothiophenic sulfur compounds from the stream to produce an adsorptively treated stream containing the other sulfur compounds, the catalytically cracked gasoline stream having an initial boiling point range including light and heavy fractions;

hydrodesulphurizing the adsorptively treated stream with a solid catalyst to separate substantially all of the other sulfur compounds from the adsorptively treated stream; and stripping the other sulfur compounds from the adsorptively treated stream to produce a product gasoline stream, whereby the product gasoline stream has a reduced sulfur content and a substantially similar octane rating as the catalytically cracked gasoline stream.

2. The process of claim 1, wherein the difference in octane loss between the catalytically cracked gasoline stream and the product gasoline stream is less than about 2 RON.

3. The process of claim 1, further including the step of regenerating the adsorbent by washing the adsorbent with a hydrocarbon solvent and drying-out the adsorbent.

4. The process of claim 3, whereby the drying temperature is in the range from 10° C. to 150° C.

5. The process of claim 3, whereby the drying temperature is in the range from 30° C. to 70° C.

6. The process of claim 3, whereby the adsorbent is subjected to vacuum pressure in the range from 0.1 mmHg to 300 mmHg during regeneration.

7. The process of claim 3, whereby the adsorbent is subjected to flowing gas selected from one or more of the group consisting of air, nitrogen, helium and argon during regeneration.

8. The process of claim 1, whereby the catalytically cracked gasoline stream is produced by fluidized catalytic cracking of one or more of the group consisting of light cycle oil, heavy cycle oil, vacuum gas oil, atmospheric resid and vacuum resid.

9. The process of claim 1, whereby the catalytically cracked gasoline stream has a total sulfur content in the range of 10 wt ppm sulfur to 20,000 wt ppm sulfur.

10. The process of claim 1, whereby the catalytically cracked gasoline stream has a total content of olefinic compounds in the range of 5 wt % to 70 wt %.

11. The process of claim 1, whereby the adsorbent is selected from one or more of the group consisting of silica, alumina, silica-alumina, zeolite, synthetic clay, natural clay, activated carbon, activated charcoal, activated carbon fiber, carbon fabric, carbon honeycomb, alumina-carbon composite, silica-carbon composite, and carbon black.

12. The process of claim 1, whereby the adsorbent contains metallic components selected from Groups VI and VIII of the periodic table.

13. The process of claim 1, whereby the adsorption is performed at a temperature in the range from 0° C. to 90° C.

14. The process of claim 1, whereby the adsorption is performed at a temperature in the range from 10° C. to 50° C.

15. The process of claim 1, whereby the hydrodesulphurizing temperature is in the range from 100° C. to 350° C.

16. The process of claim 1, whereby the hydrodesulphurizing temperature is in the range from 150° C. to 300° C.

17. The process of claim 1, whereby the hydrogen pressure is in the range from 0.5 MPa to 7 MPa.

18. The process of claim 1, whereby the hydrogen pressure is in the range from 1 MPa to 4 MPa.

19. The process of claim 1, whereby the solid catalyst comprises:

at least one compound selected from the group consisting of alumina, silica, silica-alumina, zeolite, synthetic clay, natural clay, activated carbon, activated carbon fiber, and carbon black; and at least two compounds selected from Group VIII and Group VI of the periodic table.

20. The process of claim 19, whereby the solid catalyst further comprises at least one compound selected from the group consisting of boron, nitrogen, fluorine, chlorine, phosphorous, potassium, magnesium, sodium, rubidium, calcium, lithium, strontium and barium.

21. The process of claim 1, whereby the stripping gas is selected from one or more of the group consisting of nitrogen, hydrogen, argon, and helium.

22. The process of claim 1, whereby the hydrocarbon solvent is selected from one or more of the group consisting of toluene, benzene, xylene, straight run naphtha, ethanol, isopropanol, n-butanol, i-butanol, n-pentanol, i-pentanol, ketones and ethers, and their mixtures.

23. A process for reducing the sulfur content of a catalytically cracked gasoline stream containing alkylated thiophenic, benzothiophene, alkylated benzothiophenic and other sulfur compounds comprising the steps of:

providing a catalytically cracked gasoline stream having a boiling point range of about 0° C. to 300° C.;

contacting all the catalytically cracked gasoline stream with an adsorbent to adsorptively remove substantially all the alkylated thiophenic, benzothiophene and alkylated benzothiophenic sulfur compounds from the stream to produce an adsorptively treated stream containing the other sulfur compounds, the catalytically cracked gasoline stream having an initial full boiling point range including light and heavy fractions;

splitting the adsorptively treated stream into its light and heavy fractions;

hydrodesulphurizing the heavy fraction with a solid catalyst to separate substantially all the other sulfur compounds from the heavy fraction; and stripping the separated sulfur compounds from the heavy fraction to produce a product gasoline stream, whereby the product gasoline stream has a reduced sulfur content and an increased octane rating compared to the catalytically cracked gasoline stream.

24. The process of claim 23, wherein the difference in octane loss between the catalytically cracked gasoline stream and the product gasoline stream is less than about 2 RON.

25. The process of claim 23, whereby the adsorptively treated stream is split into light and heavy fractions by fractional distillation prior to hydrodesulphurization.

26. The process of claim 23, whereby the splitting temperature is in the range from 30° C. to 120° C.

27. The process of claim 23, whereby the splitting temperature is in the range from 40° C. to 100° C.

28. The process of claim 23, whereby the light fraction is treated by caustic extraction to remove light sulfur compounds and recombined with the heavy fraction.

29. The process of claim 23, whereby the temperature of the hydrodesulphurizing reaction is in the range from 100° C. to 350° C.

30. The process of claim 23, whereby the temperature of the hydrodesulphurizing reaction is in the range from 150° C. to 300° C.

31. The process of claim 23, whereby the hydrogen pressure is in the range from 0.5 MPa to 7 MPa.

32. The process of claim 23, whereby the hydrogen pressure is in the range from 1 MPa to 4 MPa.

33. The process of claim 23, whereby the heavy fraction solid catalyst comprises:

at least one compound selected from the group consisting of alumina, silica, silica-alumina, zeolite, synthetic clay, natural clay, activated carbon, activated carbon fiber and carbon black; and at least two compounds selected from Group VIII and Group VI of the periodic table.

34. The process of claim 33, whereby the heavy fraction solid catalyst further comprises at least one compound selected from the group consisting of boron, nitrogen, fluorine, chlorine, phosphorous, potassium, magnesium, sodium, rubidium, calcium, lithium, strontium and barium.

35. The process of claim 33, in which the heavy fraction is stripped with at least one gas selected from the group consisting of nitrogen, hydrogen, argon, and helium.

36. A process for reducing the sulfur content of a coker gasoline stream containing alkylated thiophenic, benzothiophene, alkylated benzothiophenic and other sulfur compounds comprising the steps of:

providing coker gasoline stream having a boiling point range of about 0° C. to 300° C.;

contacting all the coker gasoline stream with an adsorbent to adsorptively remove substantially all the alkylated thiophenic, benzothiophene and alkylated benzothiophenic sulfur compounds from the stream to produce an adsorptively treated stream containing the other sulfur compounds, the coker gasoline stream having an initial boiling point range including light and heavy fractions;

hydrodesulphurizing the adsorptively treated stream with a solid catalyst to separate substantially all the other sulfur compounds from the adsorptively treated stream; and stripping the other sulfur compounds from the adsorptively treated stream to produce a product gasoline stream, whereby the product gasoline stream has a reduced sulfur content and an increased octane rating compared to the coker gasoline stream.

37. The process of claim 36, wherein the difference in octane loss between the coker gasoline stream and the product gasoline stream is less than about 2 RON.

38. The process of claim 36, whereby the coker gasoline stream is produced by coking of one or more of the group consisting of light cycle oil, heavy cycle oil, vacuum gas oil, atmospheric resid and vacuum resid.

39. A process for reducing the sulfur content of a coker gasoline stream containing alkylated thiophenic, benzothiophene, alkylated benzothiophenic and other sulfur compounds comprising the steps of:

providing coker gasoline stream having a boiling point range of about 0° C. to 300° C.;

contacting all the coker gasoline stream with an adsorbent to remove substantially all the alkylated thiophenic, benzothiophene and alkylated benzothiophenic sulfur compounds from the stream to produce an adsorptively treated effluent stream containing the other sulfur compounds, the coker gasoline stream having an initial boiling point range including light and heavy fractions;

splitting the adsorptively treated effluent stream into its light and heavy fractions;

hydrodesulphurizing the heavy fraction with a solid catalyst to separate substantially all the other sulfur compounds from the heavy fraction; and stripping the other sulfur compounds from the heavy fraction to produce a product gasoline stream, whereby the product gasoline stream has reduced sulfur content and an increased octane rating compared to the coker gasoline stream.

40. The process of claim 39, wherein the difference in octane loss between the coker gasoline stream and the product gasoline stream is less than about 2 RON.

41. The process of claim 39, whereby the coker gasoline stream is produced by coking of one or more of the group consisting of light cycle oil, heavy cycle oil, vacuum gas oil, atmospheric resid and vacuum resid.

* * * * *